United States Patent [19]

Levan

[11] Patent Number: 4,686,123

[45] Date of Patent: Aug. 11, 1987

[54] TURBULENT FLOW LIQUID APPLICATION APPARATUS AND A METHOD OF TURBULENTLY APPLYING A LIQUID ONTO A SUBSTRATE

[75] Inventor: Chris D. Levan, Brunswick, Ohio

[73] Assignee: Amoco Corporation, Chicago, Ill.

[21] Appl. No.: 824,066

[22] Filed: Jan. 30, 1986

[51] Int. Cl.[4] ..... B05D 1/02

[52] U.S. Cl. ..... 427/424; 118/316; 118/325; 118/326

[58] Field of Search ..... 118/316, 325, 326; 68/200, 205 R; 427/424

[56] References Cited

U.S. PATENT DOCUMENTS

| | | | |
|---|---|---|---|
| 3,172,777 | 3/1965 | Pano et al. | 118/316 X |
| 3,736,902 | 6/1973 | Glanzer | 118/325 |
| 3,899,903 | 8/1975 | Lapierre | 68/205 R |
| 4,326,894 | 4/1982 | Konnert | 118/316 X |
| 4,338,361 | 7/1982 | Lin | 68/205 R |
| 4,526,808 | 7/1985 | Strohmaier | 118/325 |

*Primary Examiner*—Shrive P. Beck

*Attorney, Agent, or Firm*—Richard J. Schlott; William H. Magidson; Ralph C. Medhurst

[57] ABSTRACT

An apparatus is disclosed for continuously applying a treating medium onto a moving substrate in a turbulent manner. The apparatus is provided with a chamber through which the substrate and the treating medium are passed. Both the upper and lower portions of the chamber each have at least one cavity which is perpendicular to the direction of travel of the substrate, wherein the respective cavities of the upper and lower portions are coaxial with one another. Each cavity contains an applicator which is capable of turbulently applying the treating medium onto the substrate. A method of treating a substrate with a treating medium using this apparatus is also disclosed. By means of the apparatus and method disclosed, a substrate can be treated in a more controlled and efficient manner.

7 Claims, 4 Drawing Figures

TURBULENT FLOW LIQUID APPLICATION APPARATUS AND A METHOD OF TURBULENTLY APPLYING A LIQUID ONTO A SUBSTRATE

BACKGROUND OF THE INVENTION

1. Field of the Invention

This invention pertains to the field of treating substrates with a treating medium. More particularly, the present invention is directed to an apparatus and method for turbulently applying a treating medium onto a substrate to more effectively apply the medium onto and throughout the substrate in a more controlled manner.

2. Discussion of Related Art

Man-made fibers are generally formed by extruding a spinning solution through a spinnerette to form a tow made up of a number of individual filaments, usually at least about 3,000 filaments, or more. In the production of these fibers, it is usually necessary to subject the tow of fibers to some kind of treatment with a liquid treating medium at some state in the manufacture of these fibers.

For example, the tow of fibers is generally washed with water for the purpose of removing a spinning solvent. Alternatively, a lubricating agent, a sizing agent, or a finishing agent may be applied to the fibers during their manufacture and as a last step before being wound onto a creel in order to improve their handleability and processability during and after manufacture. So too, the treating medium may comprise a dye to color the fibers, a washing medium to remove excess dye after a dyeing operation, or a chemical agent to modify the physical and/or chemical properties and behavior of the fibers.

Similarly, a woven cloth may also have need for being treated with a liquid treating medium during its manufacture at a textile mill. Thus, the steps of washing, dyeing, adding a finishing agent, an antistatic agent, ect. may also be applied to such a cloth as well. As used herein, the term "substrate" is meant to include one or more fibers in the form of a tow, or in a form where the fibers have been worked to form a cloth, such as, a woven or knitted fabric etc.

Various means have been employed in the prior art for applying a treating medium onto a substrate such as a tow of fibers or a fabric.

In one system, the substrate merely enters and leaves a bath containing the treating medium. For example, in some wet spinning operations, a freshly spun synthetic fiber tow is passed through one or more baths of hot water to remove the residual solvent from the filaments. A major disadvantage of this process is that it is inefficient. This inefficiency stems from the fact that circulation of the hot water around and through the moving tow is generally poor.

In another system, such as the one described in U.S. Pat. No. 3,791,788, the substrate passes through a confined zone having elaborate deflecting surfaces provided therein as the treating medium is applied. While the confined zone may aid in the effectiveness of applying the treating medium onto the substrate, this system may suffer from the disadvantage that the treating medium is applied in a manner which does not provide a satisfactory degree of agitation of the fibers within the substrate. As a result, all of the surface area of the fibers may not thoroughly be subjected to the effects of the treating medium and, most importantly, not all the fibers will have been separated from one another, i.e, deagglomerated. The treating medium is generally applied by flowing through a channel which is transverse to the direction of substrate travel. As a result, the flow pattern of the treating medium and the manner in which it impinges upon the substrate is such that it may not be effective in getting at the surface of each fiber.

In yet another system, the treating medium is applied by means of spray jets as the substrate passes in close proximity. This system of application is meant to overcome yet another disadvantage associated with each of the first two applicating systems noted above. In particular, one of the primary concerns in the production of synthetic fibers in the form of a tow is the sticking of one fiber to another which results in a decrease in the overall tensile strength of the tow. In contrast to the baths or confined treatment zones discussed above, the application of the treating medium by means of spray jets is generally able to disentangle and unstick any fibers that are joined together, particularly when the treating medium employed is an oiling agent or a finishing agent, due to the direct and forceful impingement of the fibers with the treating medium. However, when the substrate is allowed to simply freely pass past the spray jets, there is no real control as to the amount of impingement upon the fibers. As a result, the fibers usually wind up being stretched, even to the point of breakage. Such stretching and/or breaking of the fibers within a tow will generally undesirably affect its strength characteristics.

SUMMARY OF THE INVENTION

Applicant has discovered a new apparatus for applying a treating medium onto a substrate, particularly a tow of fibers, which apparatus avoids substantially all of the disadvantages and problems noted above with respect to the prior art application systems.

Applicant's apparatus is able to apply the treating medium in a turbulent manner while the substrate is in a confined zone. In this manner, a controlled amount of turbulence can be applied to the substrate such that each individual fiber is completely and uniformly contacted with the treating medium. Moreover, by virtue of the controlled turbulence within a confined treatment zone, the fibers are agitated to such an extent they are deagglomerated without, however, causing excessive stretching or breaking of the fibers. Still further, the apparatus of the present invention, in contrast to some of the more elaborate prior art systems, is simple, economical and is no more than about eight to twelve inches in length.

More specifically, in its most broadest embodiment, the apparatus of the present invention comprises an upper member, a lower member and two side members. The upper and lower members and two side members form a chamber through which the moving substrate and a treating medium pass. The upper member extends upwardly from an upper horizontal plane and the lower member extends downwardly from a lower horizontal plane. The planes are parallelly spaced apart by a distance equal to the height of the two side members. The upper member has at least one cavity extending perpendicular to the upper horizontal plane, one end of which opens into the chamber and the other end of which is adapted to receive a first means for turbulently applying treating medium onto the substrate. The lower member also has at least one cavity extending perpendicular to the lower horizontal plane one end of which opens into the chamber and the other end of which is adapted to receive a second means for turbulently applying treating medium onto the substrate wherein for each cavity present on the upper member, there is a cavity present in the lower member having the same longitudinal axis.

DETAILED DESCRIPTION OF THE INVENTION

Figure 1:
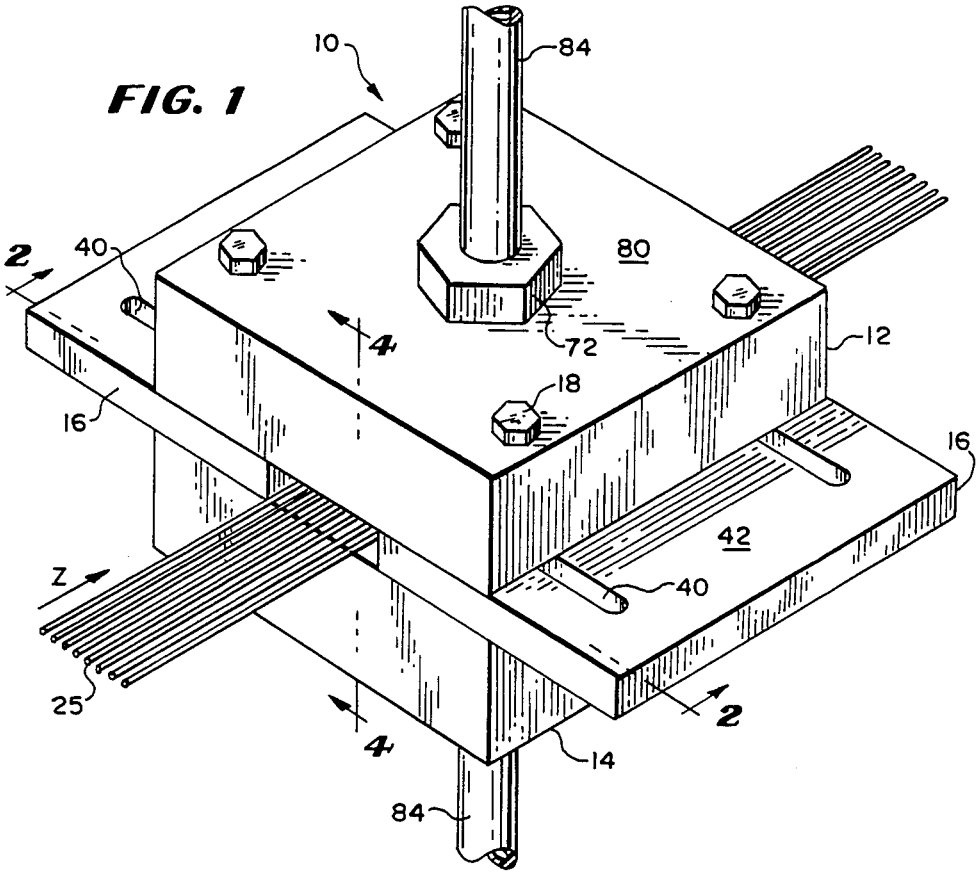
FIG. 1 is a perspective view of one embodiment of the turbulent flow liquid application apparatus of the present invention.

In order to better understand the construction and use of the apparatus and method for applying a treating medium onto a substrate in accordance with the present invention, it will be described in connection with the treatment of a filamentary tow of synthetic fibers. It is to be understood, however, that various other types of substrates, as that term has been defined herein, such as finished or partly finished fabrics, may also be treated by the apparatus and method herein.

The apparatus and method of the present invention can be utilized to remove excess or unwanted materials or fluids from a tow of fibers or from a finished or partly finished fabric. Alternatively, the present apparatus and method can be utilized to assure complete and uniform penetration of a liquid treating medium such as a dye bath, finishing additives, oiling agents, delustrants, or various other chemicals through a tow of fibers or a fabric. In either manner, the fibers are agitated in a controlled manner such that in addition to effectively applying the treating medium onto the fibers in only a short distance of fiber travel, every filament in the tow is separated from adjacent filaments to deagglomerate the fibers and to help prevent further sticking of the fibers to one another during subsequent processing but in a manner which does not adversely affect the qualities of the fibers.

Referring to the accompanying Figures, wherein like numerals designate the same apparatus element throughout the various views, there is shown a turbulent flow application apparatus generally designated as 10. The application apparatus 10 is comprised of an upper member 12 and a lower member 14 which are held in a parallelly spaced apart relationship by two side plates 16. The side plates 16 are slidably secured to the upper and lower members 12 and 14 by any conventional manner such as by a threaded rod 18 extending through the members 12 and 14 and side plates 16 which is fixed by a locking nut 20. Alternatively, the upper and lower members and the two side plates may be held together by a simple clamping means (not shown).

Figure 2:
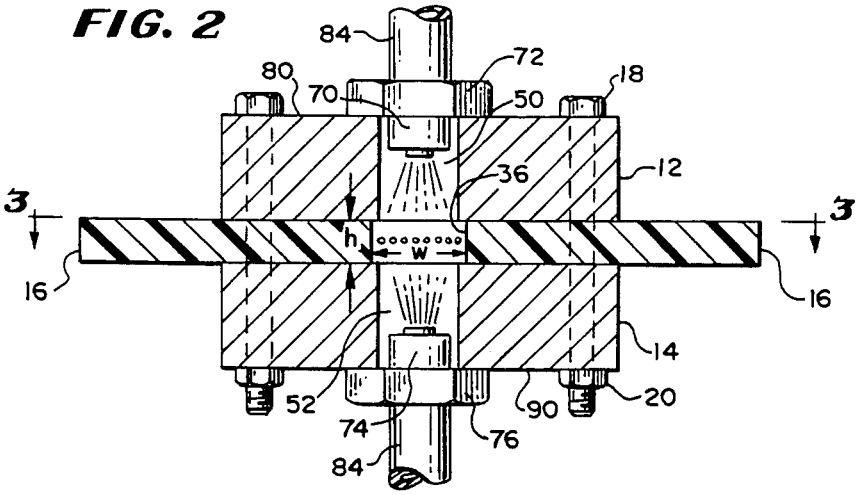
FIG. 2 is a cross-sectional view of the apparatus taken along line A—A of FIG. 1 looking at the apparatus in the direction of substrate travel.

The space between the upper and lower members 12 and 14 and side plates 16 forms a confined zone through which a substrate such as a tow of fibers 25 passes. The lower face 32 of the upper member 12 forming a horizontal plane and the upper face 34 of the lower member 14 also forming a horizontal plane and the inner faces 36 of side plates 16 define the limits of the confined zone through which the tow 25 passes. The confined zone thus has a width "w" and a height "h" as best seen in FIG. 2.

As can be seen from the drawing, tow 25 is introduced into apparatus 10 in the form of thin flat ribbon of filaments. This arrangement of filaments can generally be obtained by simply allowing a tow to freely pass over a number of rollers and thereby flatten and spread out.

The width "w" of the opening through the confined zone of the apparatus may be slightly greater in width than the flattened tow 25. The turbulent action of the treating medium on the tow causes it to spread in both the horizontal and vertical directions so that it completely and uniformly fills the area available to it within the confined zone of the apparatus.

As noted above, it is desired to have the width of the opening of the confined zone slightly greater than the width of the flattened tow 25. The width "w" can be adjusted by moving side plates 16 towards or away from each other, which plates may be provided with slots 40 extending from the upper face 42 to the lower face 32 of the plates through which rods 18 pass thereby making the plates slidably engaged with members 12 and 14.

The height "h" of the confined zone is defined by the height of the side plates 16. Generally, this height is in the range of between about 1.5 and 15 times the vertical thickness of the substrate being treated before it enters the application apparatus and is about 0.05 to about 1.0 inch.

Figure 4:
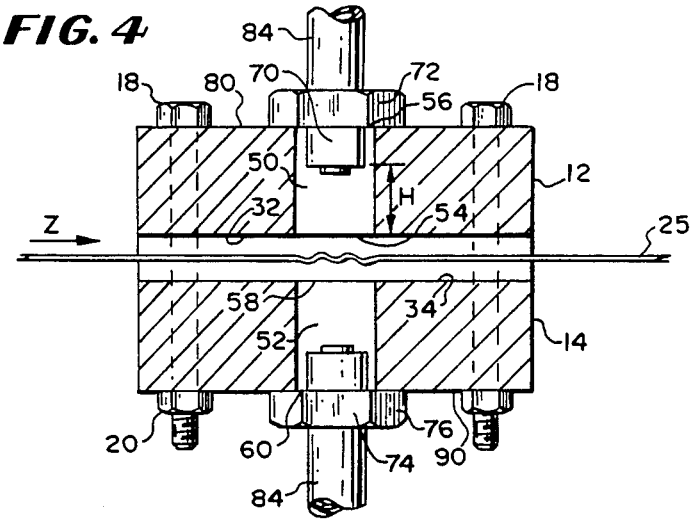
FIG. 4 is a cross-sectional view of the apparatus taken along line C—C of FIG. 1 looking at the side of the apparatus.

As can best be seen in FIGS. 2 and 4, each member 12 and 14, respectively, is provided with at least one cavity. For each cavity present in the upper member, there is a corresponding cavity present in the lower member having the same longitudinal axis. The cavities may comprise essentially any shape such as a cylindrical bore or in the shape of a parallelepiped or a prism, etc. In the embodiment shown in the Figures, a cylindrical base is depicted as the cavity contained in each of the upper and lower members. It is to be understood, however, that the apparatus of the present invention is not limited to such a configuration.

Cylindrical bore 50 contained within upper member 12 is positioned perpendicularly to the horizontal plane formed by lower face 32. The lower end 54 of cylindrical bore 50 opens into the confined zone. The upper end 56 is coextensive with upper surface 80 of upper member 12 and is adapted so as to accommodate a turbulent flow applicator means 70 which is secured by securing means 72. Similarly, cylindrical bore 52 is contained within lower member 14 and is positioned perpendicularly to the horizontal plane formed by upper face 34. The upper end 58 of cylindrical bore 52 opens into the confined zone. The lower end 60 is coextensive with lower surface 90 of lower member 14 and is adopted so as to accommodate a turbulent flow applicator means 74 which is secured by securing means 76. Bores 50 and 52 are coaxial with one another having the same longitudinal axis.

Desirably, the diameter of bores 50 and 52 are equal to one another and is substantially the same as width "w" of the confined zone. Suitably, the bore diameter is generally in the range of between about 0.25 to about 2.0 inches. The height "H" of each bore is generally such that the distance between the applicator and the substrate (shown as height H in FIG. 4) is between about 0.125 to about 2.0 inches, and preferably about 0.25 to 1.0 inch so as to provide proper impingement of the substrate with the treating medium to assure good turbulence and penetration.

Applicator means 70 and 74 may be the same or different. Suitable applicators which can effectively apply a treating medium in a controlled turbulent manner and which provide a desirable flow path include spray jets, ultrasonic probes, pulsing jets, vibratory devices and the like. Spray jets are available as nozzles, channels or spray bars. Most preferred are spray jet nozzles having an orifice diameter of between about 0.031 to 0.188 inch. In a preferred embodiment, the spray jets are mounted on a universal joint so as to make them pivotable and thereby be able to adjust the angle of treating medium impingement upon the fibers. The spray pattern emanating from a nozzle may be a hollow cone, a full cone, a solid stream, a square stream, or preferably, a flat spray pattern.

When using an ultrasonic probe, the treating medium liquid is ultrasonically vibrated desirably at 20 Khz whereby the probe transfers the high intensity energy to the moving tow of fibers. A phenomenon known as cavitation produces a shearing on anything that is near the ultrasonic probe tip. The ultrasonic energy imparted to the flowing fluid and substrate promotes agitation, blending, deagglomeration and dispersion.

In operation, the tow 25 advances through the confined zone in the direction indicated by Arrow Z. A treating medium such as water, lubricating oil, sizing agent, dye, etc. is supplied to applicators 70 and 74 via inlet conduits 84.

Figure 3:
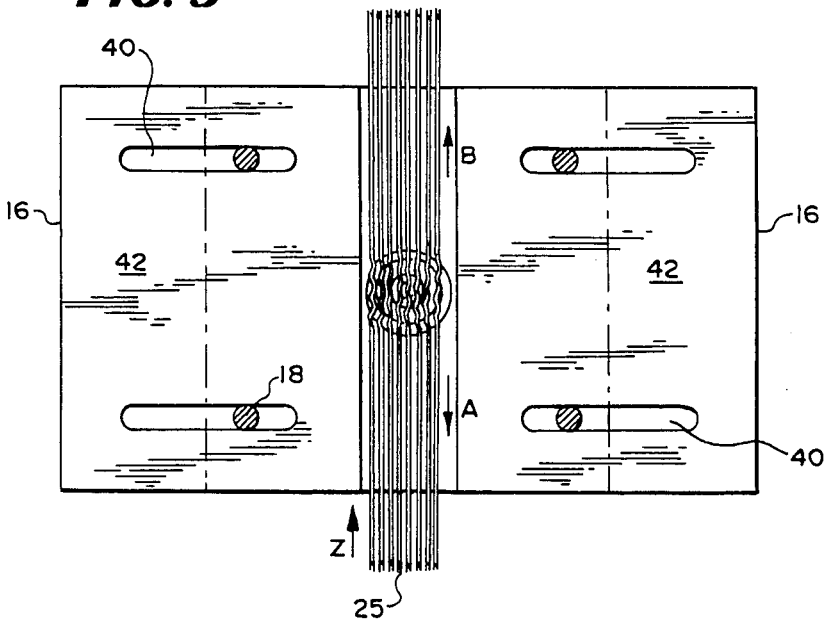
FIG. 3 is a cross sectional view of the apparatus taken along line B—B of FIG. 1 looking at the apparatus from the top.

As the tow passes over and underneath the cylindrical bore openings into the confined zone, the treating medium emanating from the applicators impinges upon the fibers from above and/or below. If only one applicator is used, the flow rate is adjusted to ensure that a turbulent flow is obtained sufficient to not only completely and uniformly contact the overall surface area of the fibers but to moreover effectively agitate and vibrate the fibers as depicted in FIG. 3 so as to cause a deagglomeration action. It has been determined that better turbulence is obtained when using only the lower applicator but that overall properties are enhanced by using both nozzles directed to impinge upon the substrate in the confined zone. Typically, the flow rate of one applicator when used alone would generally be in the range of from about 0.2 to about 2.0 gal/min.

When both applicators are simultaneously used to apply the treating medium, the treating medium leaving applicator 70 contacts and passes through tow 25 and then continues on to deflect in opposing orifice 52 and once again contacts tow 25. Similarly, the treating medium leaving applicator 74 contacts and passes through tow 25 and then continues on to deflect in opposing orifice 50 from where it once again contacts tow 25. A similar effect is obtained when only one applicator is utilized. The action of the treating medium flowing in one direction and then deflecting so that it essentially reverses its direction and flows in the other direction is enough to create the sought after turbulence.

When both applicators are used, the overall action of the treating medium flowing in both directions simultaneously and then deflecting in the opposing orifice where it reverses direction and then joins with the flow of the applicator in that orifice is such that an extremely turbulent zone is created which is very efficient in applying the treating medium onto and throughout the fibers and, moreover, is extremely efficient in deagglomerating the fibers. Despite this extreme turbulence, excessive stretching of the fibers or breaking of the fibers is nevertheless essentially prevented due to the fact that the tow of fibers enters this turbulent zone while contained within the confined treatment zone. When both applicators are used, the flow rate of the treating medium through one applicator is generally also in the range of between about 0.2 to about 2.0 gal/min.

The treating medium leaving apparatus 10 leaves countercurrently as shown by Arrow A in FIG. 3 through the fiber inlet side of the confined zone of the apparatus and cocurrently as shown by Arrow B through the fiber outlet side of the confined zone. Desirably, a collection tank (not shown) is situated immediately beneath the application apparatus to collect the treating medium as it leaves and recycle it to the apparatus.

Preferably, various parts of the application apparatus are made from materials which offer the minimum amount of friction against the fibers so as to reduce the possibility of fiber fraying. Such materials include but are not limited to Teflon, polished chrome platings, glass, ceramics, and the like, and would be most beneficial if used as the material of construction for the upper and lower members 12 and 14 and side plates 16.

It is to be understood that the embodiment disclosed herein is merely illustrative and that this embodiment can be modified or amended and that numerous other embodiments can be contemplated without departing from the spirit and scope of the present invention.

What is claimed is:

1. An apparatus for treating a moving substrate with a treating medium comprising an upper member, a lower member and two side plates; said upper and lower members and two side plates forming a chamber through which the moving substrate and a treating medium pass; said upper member extending upward from an upper horizontal plane; said lower member extending downward from a lower horizontal plane; said planes being parallelly spaced apart by a distance equal to the height of the two side plates, said height being in the range of from about 0.05 to 1.0 inch; said upper member having at least one cavity extending perpendicularly to the upper horizontal plane, one end of said cavity opening into the said chamber and the other end of said cavity being adapted to receive a first means for turbulently applying treating medium onto the substrate; said lower member having at least one cavity extending perpendicularly to the lower horizontal plane, one end of said lower member cavity opening into the said chamber and the other end of said lower member cavity being adapted to receive a second means for turbulently applying treating medium onto the substrate; said upper member cavity and lower member cavity having the same longitudinal axis.

2. The apparatus of claim 1, wherein the means for applying treating medium includes an ultrasonic probe.

3. The apparatus of claim 1, wherein the side plates are slidably engaged in the apparatus in a direction transverse to the direction of travel of the substrate such that the width of the chamber can be altered.

4. The apparatus of claim 3, wherein the width of said chamber is slightly greater that the width of the substrate.

5. An apparatus for treating a moving filamentary tow with a treating medium comprising an upper member, a lower member and two side plates; said upper and lower members and two side plates forming a chamber through which the moving filamentary tow and a treating medium pass; said upper member extending upward from an upper horizontal plane; said lower member extending downward from a lower horizontal plane; said planes being parallelly spaced apart by a distance equal to the height of the two side plates, said height being in the range of from about 0.05 to 1.0 inch; said upper member having a first cylindrical bore perpendicular to the upper horizontal plane, one end of said bore opening into the said chamber and the other end of said bore being adapted to receive a first spraying means for spraying treating medium onto the filamentary tow; said lower member having a second cylindrical bore perpendicular to the lower horizontal plane, one end of said second bore opening into the said chamber and the other end of said second bore being adapted to receive a second spraying means for spraying treating medium onto the filamentary tow; said first bore and second bore having the same longitudinal axis.

6. The apparatus of claim 5, wherein the side plates are slidably engaged in the apparatus in a direction transverse to the direction of travel of the filamentary tow such that the width of the chamber can be altered.

7. The apparatus of claim 6, wherein the width of said chamber is slightly greater that the width of the filamentary tow.

* * * * *